US006237703B1

(12) United States Patent
Draney et al.

(10) Patent No.: US 6,237,703 B1
(45) Date of Patent: May 29, 2001

(54) PIPE CARTRIDGE FOR A HORIZONTAL DIRECTIONAL DRILL

(75) Inventors: Robert G. Draney, Derby, KS (US); Christopher G. Kay, Roseville, MN (US); Jeffrey S. Volden, Burlington, IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/502,688

(22) Filed: Feb. 11, 2000

(51) Int. Cl.[7] ..... E21B 19/14

(52) U.S. Cl. ..... 175/162; 175/162; 166/77.51

(58) Field of Search ..... 175/52, 85, 162; 166/77.1, 77.51, 77.52, 85.1

(56) References Cited

U.S. PATENT DOCUMENTS 3,877,583 * 4/1975 Bokenkamp ..... 175/85 X
4,460,303 * 7/1984 Miller ..... 175/85 X
4,610,315 * 9/1986 Koga et al. ..... 175/85
5,183,122 * 2/1993 Rowbotham et al. ..... 175/52
5,297,642 * 3/1994 Rajakallio et al. ..... 185/85
5,437,527 * 8/1995 McGill et al. ..... 175/52 X
5,687,804 * 11/1997 Lappalainen et al. ..... 175/52

* cited by examiner

*Primary Examiner*—Frank Tsay
(74) *Attorney, Agent, or Firm*—Richard G. Lione; Brinks Hofer Gilson & Lione

(57) ABSTRACT

A cartridge for storing pipe lengths on a horizontal directional drill that allows easy loading and unloading of pipes from the cartridge while it is attached to the drill. Longitudinal support members and towers at each end of the cartridge provide structural support to the cartridge and maintain the pipe lengths within the cartridge. The sides of the cartridge are open and unobstructed. Loading and unloading of pipes can, therefore, be done through the sides of the cartridge.

19 Claims, 3 Drawing Sheets

PIPE CARTRIDGE FOR A HORIZONTAL DIRECTIONAL DRILL

FIELD OF THE INVENTION

The present invention relates generally to horizontal directional drill machines. It relates particularly to a stake-down assembly for a horizontal directional drill machine.

BACKGROUND OF THE INVENTION

A horizontal directional drill machine is a common and well-known machine for installing pipes beneath the ground and generally parallel to the surface. These machines are used in many different applications and are available in a wide range of sizes. Typical applications where a horizontal directional drill machine might be used include the installation of fiber optic cables, electrical cables, gas lines, water systems, or sewer systems. Horizontal directional drill machines are commonly rated in terms of pull-back capacity. Some machines for smaller applications have as little as five thousand pounds of pull-back capacity. Other machines are available with a pull-back capacity of as much as one million pounds.

One alternative to a horizontal directional drill machine is the traditional trencher machine. A trencher machine simply digs a trench into the ground, and after (for example) pipe is laid down in the bottom of the trench, the trench is filled and the pipe is buried. The advantage of a horizontal directional drill machine over a trenching machine is that a pipe can be buried in the ground over long distances without digging a trench. Thus, a horizontal directional drill is particularly desirable when a trench would be difficult or too costly to dig. For example, a horizontal directional drill machine finds particularly advantageous application for installing pipes under roadways, where destruction of the road is expensive and inconvenient to travelers, or under a waterway like a river, where trenching would be impossible.

A unique aspect of a horizontal directional drill machine is the special drill head that is attached to the front end of a pipe to be laid. The drill head has an angled shape which allows the operator to change the direction of the pipe after it has entered the ground. Direction changes are achieved by stopping the pipe and drill head rotation and orienting the drill head at a desired angle. Then, by pushing on the drill pipe without rotating it, the drill head and attached pipe will veer in the desired direction. Thus, by effecting directional changes to pipe travel, a pipe might enter the ground at an angle, travel horizontally over a long distance, and exit the ground at another angle. This ability to change the direction of pipe travel also allows the operator to steer the pipe around underground obstacles like boulders.

A completely drilled pipe length is made up of an assembly of shorter pipe lengths that are attached to each other end to end. As the pipe is drilled through the ground successive pipe lengths are attached to the preceding pipe assembly to provide additional length. The additional pipe lengths are stored on the drill in a cartridge, and the bottom pipes in the cartridge are successively attached to the preceding pipe assembly with the aid of a loader. Typically, the cartridge is detachable from the drill body to allow the cartridge to be fully loaded with pipes away from the drill, but this feature is not a necessity for operation of the drill.

Frequently, a need arises during operation of the drill to access the stored pipe lengths in the cartridge while the cartridge is still attached to the drill body. This can occur when a pipe assembly is nearly fully drilled, but a small number of pipe lengths are still required for completion.

Instead of detaching the cartridge and attaching a new cartridge fully loaded with new pipe lengths, it is often more convenient to individually load the additional pipe lengths required into the already attached, but empty, cartridge. Additionally, equipment problems can occasionally occur with the drill so that the stored pipes have to be removed one by one from the cartridge while it is still attached to the drill. This situation might arise if the loader assembly fails and the bottom pipe becomes jammed.

Although cartridge and pipe sizes vary widely depending on the size of the drill, the cartridge is commonly between two and three feet deep from its top to the bottom, and the pipes can weigh about seventy-five pounds each. Prior art cartridges support the pipe lengths between side walls that extend longitudinally along the cartridge. These cartridges are loaded and unloaded from the top of the cartridge. Loading and unloading heavy pipes through the top of the cartridge can be difficult and can cause back injuries. Depending on whether the operator is loading or unloading, he must also lower the pipe down into the bottom or lift the pipe up from the bottom of the cartridge through the entire depth of about two to three feet. It is therefore desirable to have a cartridge that would allow easier loading and unloading of the pipes while the cartridge is attached to the drill.

BRIEF SUMMARY OF THE INVENTION

It is an object of the invention to provide an improved pipe cartridge for a horizontal, directional drill.

It is another object to provide a cartridge which allows pipes to be loaded and unloaded from the sides of the cartridge, instead of from the top.

According to the invention, the cartridge includes longitudinal support members that extend along a lower part of the cartridge. Each end of the cartridge comprises a tower including side plates, an end plate, and dividing plates. The side plates restrain side-to-side movement of the pipes. The end plates restrain end-to-end movement of the pipes, while the dividing plates extend vertically within the cartridge to separate the pipes into columns. The sides of the cartridge are open between the towers. Pipes can, therefore, be loaded into the cartridge by angling one end of the pipe into the cartridge from the side and lifting the other end up over a tower. To unload a pipe, the procedure is simply reversed.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION OF THE INVENTION

Figure 1:
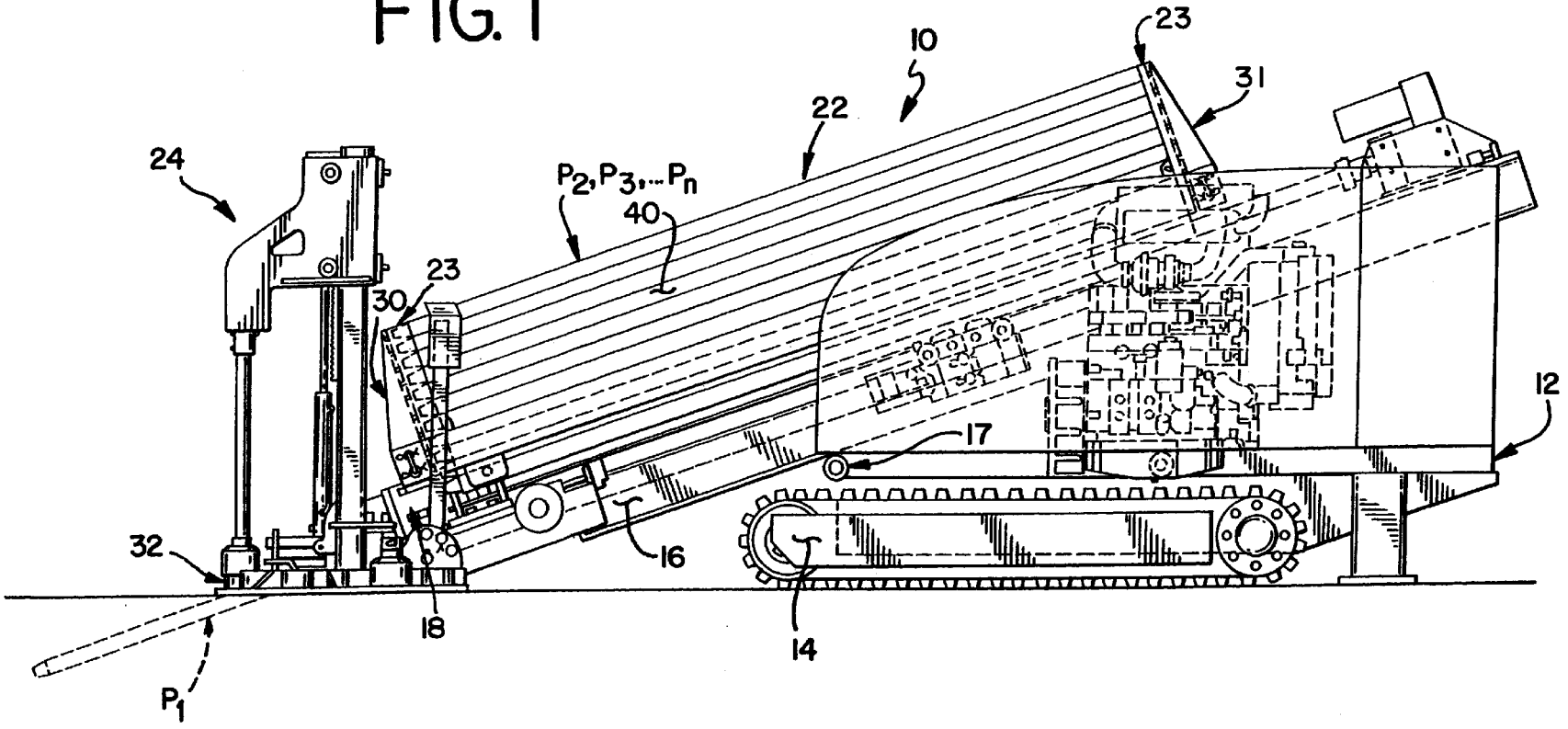
FIG. 1 is a side elevational view of a horizontal directional drill, showing the drill in its operating mode with the cartridge fully loaded with pipes.

Referring now to the drawings, and particularly to FIG. 1, a horizontal directional drill machine is shown generally at 10. The drill 10 includes a frame 12 supported by driven tracks 14 for moving the drill machine 10 from place to place.

The drill machine 10 includes a longitudinally elongated boom 16 pivotally mounted on the front end of the frame 12, as at 17. A conventional pipe drill assembly 18 is mounted on the boom 16, extending coextensively therewith. The drill assembly 18 is designed to drill a series of pipe sections $P_1$, $P_2$, $P_3$, et seq., into the ground, in sequence.

In the operating mode of the drill machine 10, the boom 16 is pivoted upward away from the frame 12 so that pipe section $P_1$ extends from the drill assembly 18 and intersects the ground at an angle. A special drill head (not shown) is attached to the front end of the first drill pipe section $P_1$. In order to drill the pipe section P1 into the ground and make any desired directional changes in its path, a variety of push, pull, and rotational forces are applied to the pipe section $P_1$ by the drill assembly 18. The manner in which the drill assembly 18 applies these forces to the drill pipe section $P_1$ are not described, but are well known to those skilled in the art.

As the first pipe section $P_1$ is drilled into the ground, new pipe sections $P_2$, $P_3$, et seq., are successively attached to the rear end of the preceding pipe sections. A cartridge 22 of pipe sections $P_2$, $P_3$, et seq. is provided on the boom 16 for storing these additional pipe sections, and a semi-automatic or fully automatic loader (not shown) may be provided for attaching them to the preceding pipe sections.

Figure 2:
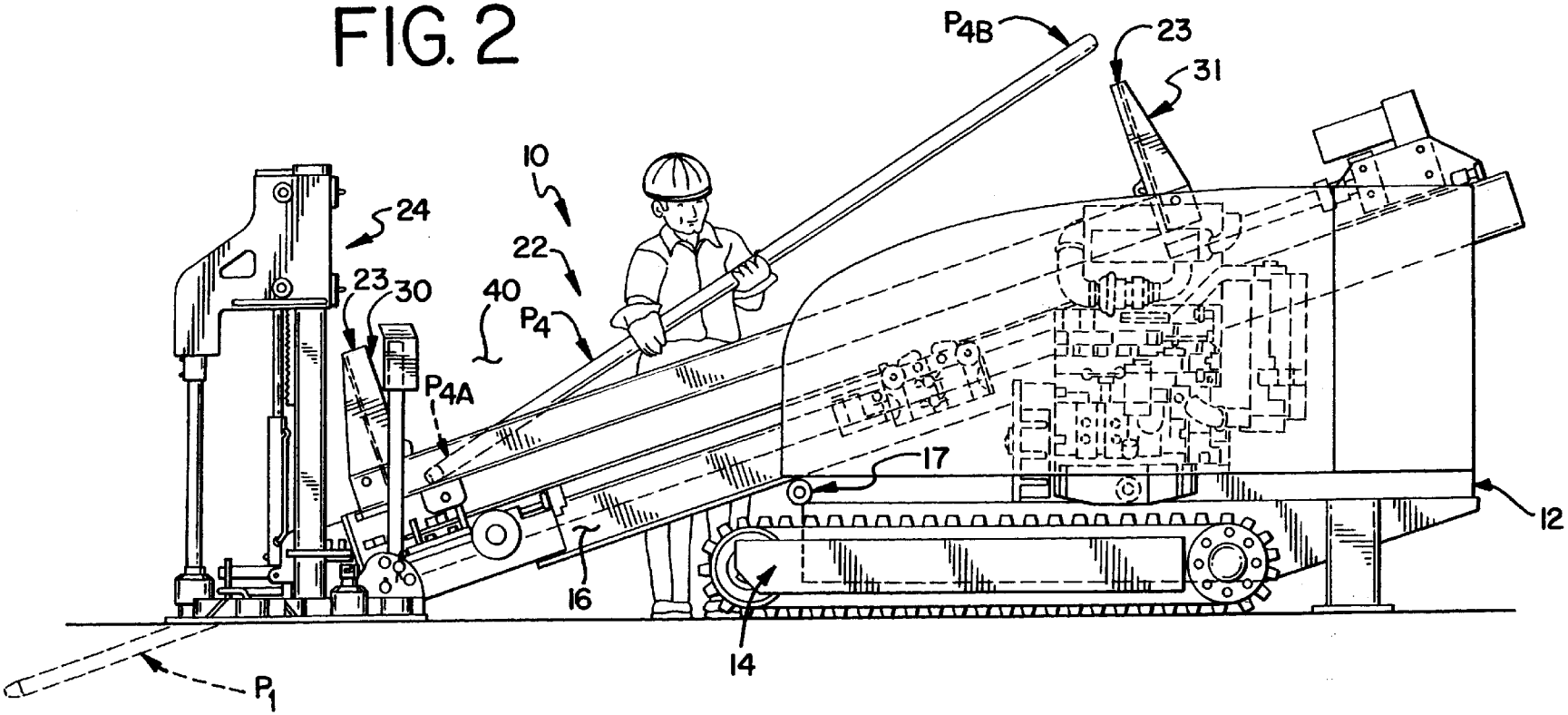
FIG. 2 is a side elevational view of a horizontal directional drill, showing the drill in its operating mode with the cartridge empty and an operator loading a new pipe into the cartridge.
Figure 3:
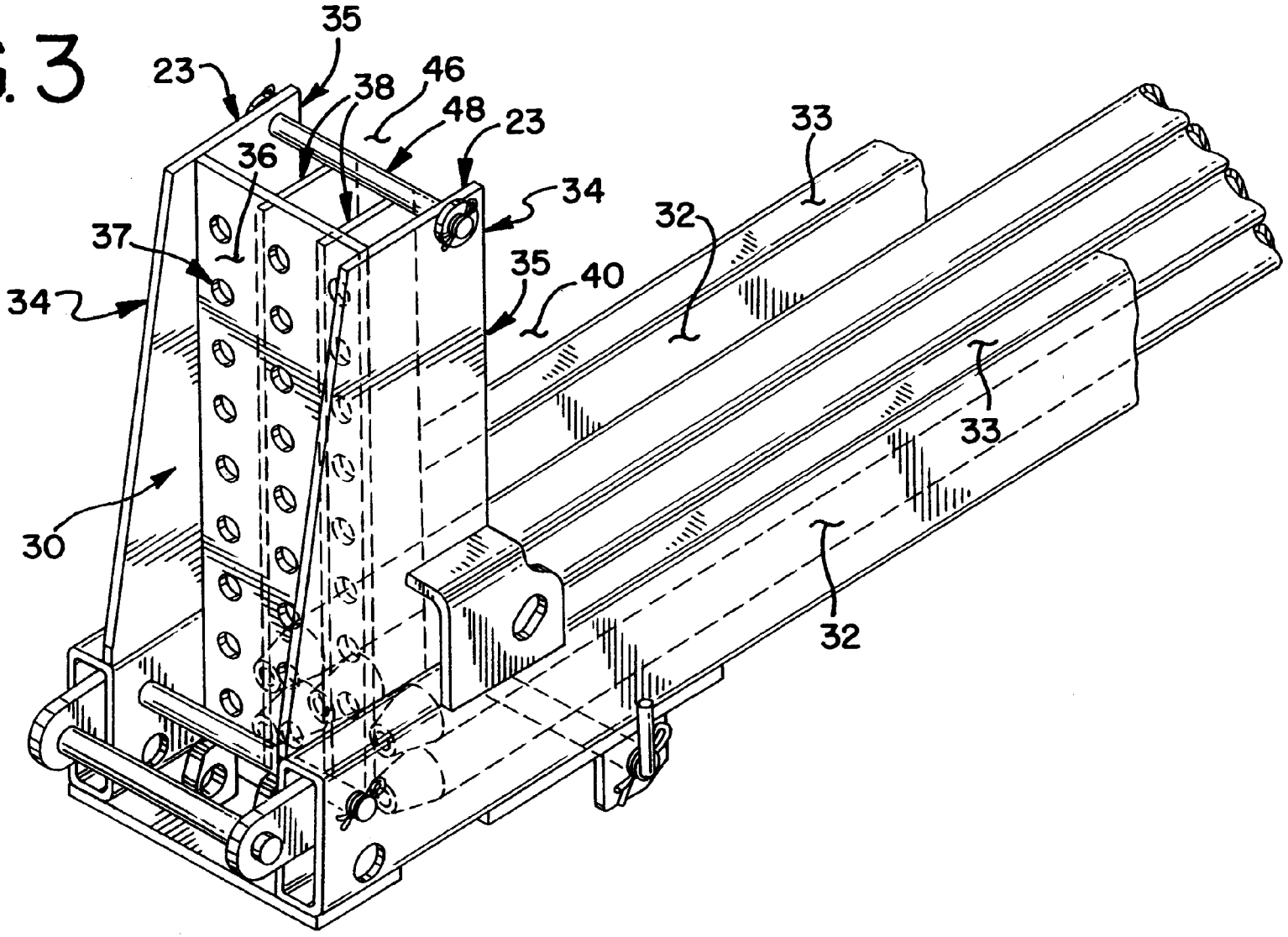
FIG. 3 is a perspective view of one end of the cartridge, with the cartridge about half full of pipes.

Turning now to FIGS. 2 and 3, according to the invention the cartridge 22 includes a front end tower 30 and a rear end tower 31. Connecting the two towers 30 and 31 are longitudinal support members 32 which extend along a lower part of the cartridge 22 on the outer sides.

The towers 30 and 31 each include side plates 34 which extend a short distance longitudinally of the cartridge 22. The side plates 34 extend up to define the top 23 of the cartridge 22. End plates 36 extend between the side plates 34 and, also, up to the top 23 of the cartridge 22.

A series of dividing plates 38 are provided for separating the columns of pipes. The dividing plates 38 are attached to the end plates 36. Each extends up to the top 23 of the cartridge 22 between the end plates 36.

The top 46 of the cartridge 22 is open between the side plates 34 and the end plates 36. The open top 46 permits reloading the cartridge 22 with new pipes P when the cartridge 22 is detached from the drill 10. Removable pins 48 are installed through the tower side plates 34 and prevent the pipes P from inadvertently coming out of the cartridge 22 through the open top 46.

It has been discovered that the support structure of the towers 30 and the longitudinal support members 32 make cross bars or walls extending along the sides of the cartridge 22 unnecessary. Therefore, as can be readily appreciated from the drawings, the sides of the cartridge 22 are open.

Referring specifically to FIG. 2, the ease with which pipe lengths P can be loaded and unloaded through the open sides of the cartridge 22 is readily apparent. To load a new pipe length P into the cartridge 22, the front end of the pipe length is angled into the interior of the cartridge 22 through the open top 40. The pipe length P is aligned with the desired column by placing one end of the pipe length against the end plate 36 between two dividing plates 38 or a dividing plate 38 and a side plate 34. Then, the other end of the pipe length is lifted up and over the nearest side plate 34. Finally, the other end is lowered through the top 46 (with pin 48 removed) down into the bottom of the cartridge 22 between the two dividing plates 38 or a dividing plate 38 and a side plate 34. To remove a pipe length P from the cartridge 22, the process is reversed.

While the pipe lengths are in the cartridge 22, they sometimes drip water, sludge or debris which then carry. A plurality of drain holes 37 are provided in the end plates 36 to allow it to escape.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

What is claimed is:

1. A horizontal directional drill comprising:

a) a cartridge for storing a plurality of drilling pipes;

b) said cartridge having a tower at each end of said drilling pipes for maintaining the drilling pipes in their proper storage position, i) said towers having side portions on the outside of said drilling pipes that extend longitudinally along a partial length of the drilling pipes for restricting side-to-side movement of the drilling pipes; and c) said cartridge having an open portion on the outside of said drilling pipes along one or both sides, i) said open portion extending between the end edges of said side portions, and ii) said open portion extending from a top of said cartridge down to a point below said top of the cartridge.

2. The horizontal directional drill according to claim 1 wherein the horizontal directional drill is rated for greater than 5,000 pounds of pull.

3. The horizontal directional drill according to claim 1 wherein the horizontal directional drill is rated for about 30,000 pounds of pull.

4. The horizontal directional drill according to claim 2 wherein said cartridge includes lower support members that extend longitudinally along a lower portion of the cartridge for providing structural stability to the cartridge.

5. The horizontal directional drill according to claim 4 wherein said lower support members extend along the outside of said drilling pipes.

6. The horizontal directional drill according to claim 5 wherein said open portion extends from said top of said cartridge down to said support members.

7. The horizontal directional drill according to claim 6 wherein said cartridge is detachably connected to the horizontal directional drill.

8. The horizontal directional drill according to claim 7 wherein means are provided so that said drilling pipes can be stored in said cartridge when it is detached from the horizontal directional drill.

9. The horizontal directional drill according to claim 8 wherein said towers include end plates that restrict longitudinal movement of said drilling pipes.

10. A horizontal directional drill comprising:

a) a cartridge for storing a plurality of drilling pipes;

b) said cartridge having a tower at each end of said drilling pipes for maintaining the drilling pipes in their proper storage position, i) said towers having side portions on the outside of said drilling pipes that extend longitudinally along a partial length of the drilling pipes for restricting side-to-side movement of the drilling pipes;

c) said cartridge being open along a part of a top side of the cartridge; and d) said cartridge having an open portion on the outside of said drilling pipes along one or both sides, i) said open portion extending between the end edges of said side portions, and ii) said open portion extending from a top of said cartridge down to a point below said top of the cartridge.

11. The horizontal directional drill according to claim 10 wherein said cartridge is detachably connected to the horizontal directional drill.

12. The horizontal directional drill according to claim 11 wherein one means is provided for supporting the weight of said drilling pipes when said cartridge is attached to the horizontal directional drill and a different means is provided for supporting the weight of the drilling pipes when the cartridge is detached from the horizontal directional drill.

13. The horizontal directional drill according to claim 12 wherein said towers include end plates that restrict longitudinal movement of said drilling pipes.

14. The horizontal directional drill according to claim 13 wherein said cartridge includes lower support members that extend longitudinally along a lower portion of the cartridge for providing structural stability to the cartridge.

15. The horizontal directional drill according to claim 14 wherein the horizontal directional drill is rated for greater than 10,000 pounds of pull.

16. The horizontal directional drill according to claim 14 wherein the horizontal directional drill is rated for about 30,000 pounds of pull.

17. A horizontal directional drill comprising:

a) a cartridge for storing a plurality of drilling pipes;

b) said cartridge having lower support members that extend longitudinally along the outside of said drilling pipes along a lower portion of the cartridge for providing structural stability to the cartridge;

c) said cartridge having a tower at each end of said drilling pipes for maintaining the drilling pipes in their proper storage position, i) said towers having side portions on the outside of said drilling pipes that extend longitudinally along a partial length of the drilling pipes for restricting side-to-side movement of the drilling pipes, and ii) said towers having end plates that restrict longitudinal movement of said drilling pipes;

d) said cartridge being detachably connected to said horizontal directional drill so that the cartridge can be attached or detached from the horizontal directional drill while said drilling pipes are stored within the cartridge;

e) means on the bottom of said cartridge for supporting the weight of said drilling pipes, i) said means being of one means when said cartridge is attached to said horizontal directional drill and being a different means when said cartridge is detached from said horizontal directional drill;

f) said cartridge being open along a top side of the cartridge so that said drilling pipes can be loaded from said top side into the cartridge when the cartridge is either attached to or detached from said horizontal directional drill; and g) said cartridge having an open portion on the outside of said drilling pipes along one or both sides, i) said open portion extending between the end edges of said side portions, and ii) said open portion extending from a top of said cartridge down to said support members.

18. The horizontal directional drill according to claim 17 wherein the horizontal directional drill is rated for 5,000 to 50,000 pounds of pull.

19. The horizontal directional drill according to claim 17 wherein the horizontal directional drill is rated for about 30,000 pounds of pull.

* * * * *